US006402136B1

(12) United States Patent
Lamothe

(10) Patent No.: US 6,402,136 B1
(45) Date of Patent: Jun. 11, 2002

(54) APPARATUS FOR MERGING MULTIPLE STREAMS OF DOCUMENTS INTO A SINGLE STREAM

(75) Inventor: Richard P. Lamothe, Burlington, CT (US)

(73) Assignee: Energy Saving Products and Sales Corporation, Burlington, CT (US)

( * ) Notice: Subject to any disclaimer, the term of this patent is extended or adjusted under 35 U.S.C. 154(b) by 0 days.

(21) Appl. No.: 09/569,702

(22) Filed: May 12, 2000

Related U.S. Application Data

(60) Provisional application No. 60/134,270, filed on May 14, 1999.

(51) Int. Cl.[7] ..... B65H 29/22

(52) U.S. Cl. ..... 271/185; 271/225; 270/52.09; 270/58.23; 242/615.21

(58) Field of Search ..... 271/183, 184, 271/185, 225; 270/52.07, 52.08, 52.09, 52.14, 58.23, 58.29; 242/615.21

(56) References Cited

U.S. PATENT DOCUMENTS 265,298 A * 10/1882 Anthony et al. ..... 270/52.08
697,174 A * 4/1902 Roesen ..... 270/52.07 X
2,132,827 A * 10/1938 Meisel ..... 270/52.07 X
3,433,136 A * 3/1969 Hartbauer et al. ... 270/52.09 X
4,939,888 A * 7/1990 Katz et al. ..... 270/52.09 X
5,362,039 A * 11/1994 Kusters ..... 271/183 X

* cited by examiner

*Primary Examiner*—Christopher P. Ellis
*Assistant Examiner*—Patrick Mackey
(74) *Attorney, Agent, or Firm*—McCormick, Paulding & Huber LLP

(57) ABSTRACT

A system for merging multiple streams of documents in side-by-side relation, such as cut from a paper web, into a single document stream is provided. Each document of a document stream passes over a turnbar driven that inverts and redirects the document, a primary conveyor carries the documents in side-by-side relation toward the turnbars, and a cross conveyor carries the documents away in a single merged document stream. The cross conveyor is angled with respect to the primary conveyor, and the turnbars are angled with respect to each conveyor. The turnbars may be staggered and adjusted to output the documents in any order, and the invention may handle two, three, or more simultaneous document streams. The turnbars may be driven by a single drive means which may be reversible, and may be repositioned to direct documents in either direction the cross conveyor may operate.

7 Claims, 5 Drawing Sheets

APPARATUS FOR MERGING MULTIPLE STREAMS OF DOCUMENTS INTO A SINGLE STREAM

CROSS REFERENCE TO RELATED APPLICATIONS

This application claims priority under 35 U.S.C. § 120 of co-pending provisional application number 60/134,270, filed May 14, 1999.

FIELD OF THE INVENTION

This invention relates generally to an apparatus for combining multiple document streams into a single merged document stream. It relates more particularly to collating multiple documents in side-by-side relation, such as those cut from a paper web, into a single merged stream of documents for further stacking or handling.

BACKGROUND OF THE INVENTION

Numerous appurtenances for handling printed matter, such as mass mailing collators, are predicated on the input condition of the printed matter being fed as either a stack of documents or a single stream. See U.S. Pat. No. 5,704,604: "Process And Device For Forming And Transferring Stacks Of Printed Sheets". Yet the greatest printing efficiencies arise when using a large roll of paper web, such as that illustrated in co-owned U.S. Pat. No. 5,505,401: "Machine For Manipulating Web Material". Printing on such industrial sized rolls of paper web typically results in three or more documents in side-by-side relation once the web is cut into individual pages.

The variety of collating systems for combining documents in side-by-side relation into a comprehensive stack or stream has been limited only to pairs of documents. See generally U.S. Pat. No. 5,947,461: "Apparatus And Method For Collating Documents Cut From A Continuous Web". Thus the prior art leaves a technological gap whereby the efficiencies of printing and handling of printed documents can never be simultaneously maximized.

Several attempts have been directed at closing this gap by increasing collator capacity, since collators typically have not operated at the speeds of printers. See U.S. Pat. No. 5,083,769, "Dual Collating Machine". In order to preclude frequent starting and stopping of the printer when the collator is running at capacity, complicated and expensive machinery has been required to provide multiple conveyor paths for documents to be merged. While effective at reducing wear on mechanical components and increasing the speed at which the printer may continuously operate, these attempts are more technically sophisticated than need be to perform the essential function of merging multiple streams of documents. They add greatly to both capital and maintenance costs, require excessive floor space, and their numerous high-speed moving parts are more prone to failure.

In typical prior art systems for handling such continuous web paper fed at widely varying speeds, the paper is provided with tractor pin feed holes along the marginal edges to track the web properly during the speed and direction changes dictated by modern printers. While attempts have been made to adapt such systems to a pinless web feeding system, such devices tend to be overly complex. See for example U.S. Pat. No. 5,820,007.

What is needed in the art is an apparatus to merge multiple document streams in side-by-side relation, such as streams printed and cut from a web, into a single merged document stream. A simpler and more compact apparatus that can be employed in both medium and large commercial printing establishments will best meet this need. It is an object of the present invention to provide this apparatus, which will alleviate some of the above deficiencies in the prior art. It is a further object of this invention to provide for merging multiple streams of documents in varying orders selected by the operator.

SUMMARY OF THE INVENTION

In accordance with the present invention, a conveyor system for merging multiple streams of documents is provided, comprising means to invert and redirect each document stream into a merged document stream, a primary conveyor to transport each document stream toward said means to invert and redirect, and a cross conveyor to transport the merged document stream away from the means to invert and redirect. In the preferred embodiment of the present invention, the means to invert and redirect further includes means to overlap at least a portion of each document in a document stream with the merged document stream.

BRIEF DESCRIPTION OF THE DRAWINGS

A more complete understanding of the present invention and many of its attendant advantages will be readily appreciated and better understood by reference to the following detailed description when considered in conjunction with the accompanying drawings, wherein.

DETAILED DESCRIPTION OF THE PREFERRED AND ALTERNATIVE EMBODIMENTS

Figure 1:
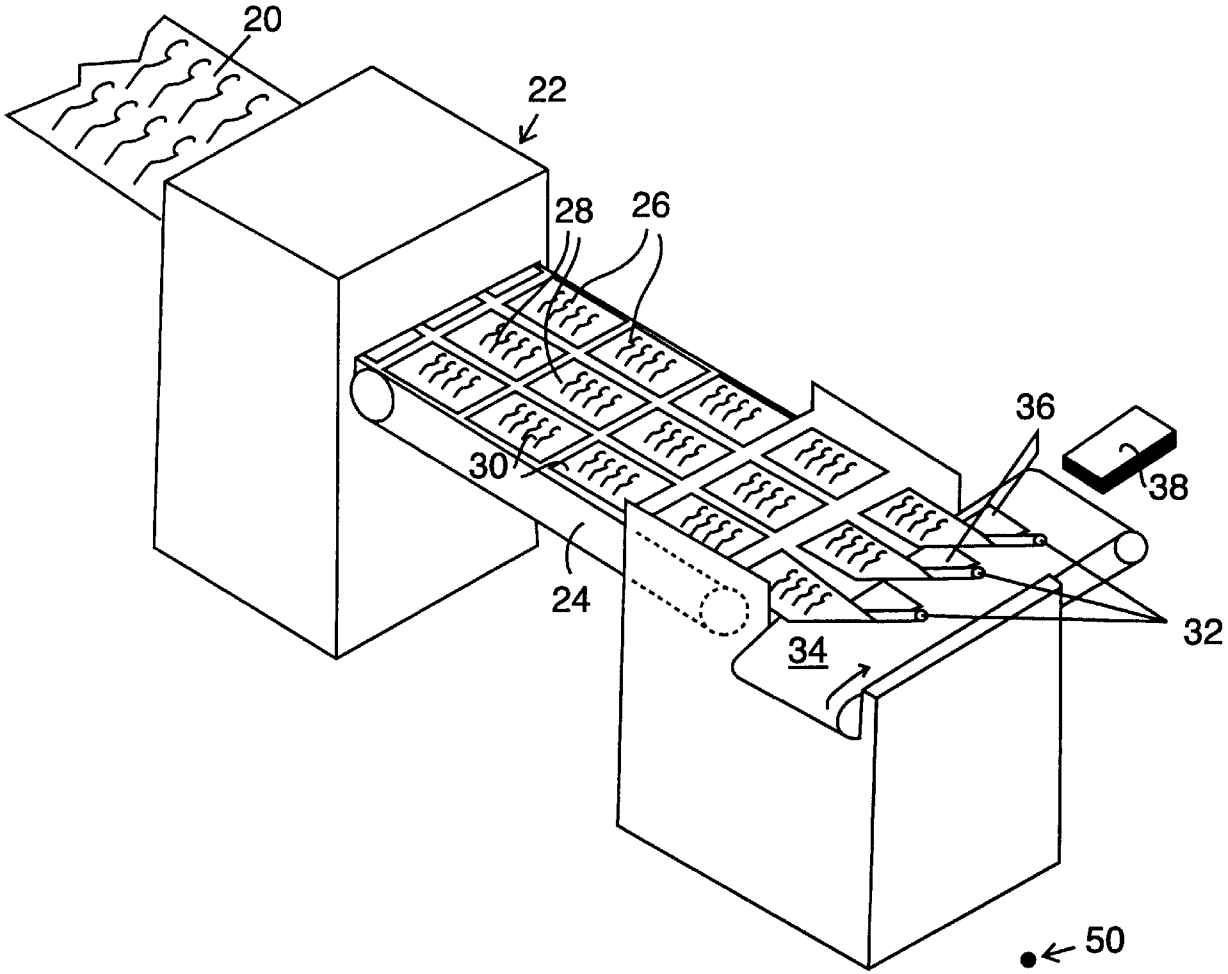
FIG. 1 is a perspective view of the preferred embodiment, showing three document streams merging into a single document stream.

Turning now to the drawings in greater detail, FIG. 1 shows a continuous paper web 20 fed into a cutter 22 which cuts the web into individual documents or pages. The resulting pages exit the cutter 22 on a primary conveyor 24 in three document streams in side-by-side relation to each other. These are arbitrarily labeled a first document stream 26 (farthest from the observer in FIG. 1), second document stream 28 (center stream), and third document stream 30 (nearest the observer). The primary conveyor 24 carries the document streams in this fashion toward rollers or turnbars 32, wherein the number of turnbars matches the number of document streams and each turnbar manipulates documents only from its respective document stream. Each document passes over a turnbar, and around the turnbar in a desired direction. Thus the turnbar pulls a corner of each document downward to direct it in the direction of a cross conveyor 34. The cross conveyor continuously pulls each document over its respective turnbar and carries it away in a single merged document stream 36. The cross conveyor 34 may then deposit this merged document stream 36 onto a document stack 38 or toward other post-printing machinery to handle, fold, bundle, or otherwise manipulate the resultant single stream of documents.

It is an important feature of this invention that the turnbars both invert and redirect each document that passes over them. Each document is inverted in that the side facing up while on the primary conveyor 24 is turned to face down while on the cross conveyor 34, while simultaneously redirected from alignment with the primary conveyor 24 to alignment with the cross conveyor 34.

In the preferred embodiment shown, the cross conveyor 34 is oriented perpendicular to the primary conveyor 24, but such orientation is merely. the most efficient and not the only practical embodiment. As long as the turnbars and cross conveyor are so oriented as to redirect each document stream to the cross conveyor, multiple streams of documents are successfully merged.

The turnbars 32 are oriented at an angle with respect to both the primary conveyor 24 and the cross conveyor 34. Since the preferred embodiment orients both conveyors perpendicular to each other, the turnbars are oriented at 45° relative to each conveyor (24 and 34). The turnbars preferably are parallel to one another and lie in the same horizontal plane. The primary conveyor 24 is also in this plane and the cross conveyor 34 lies in a slightly lower horizontal plane, so that an edge of each document in a document stream will be wrapped around the turnbar and be directed along the cross conveyor, which feeds the documents toward an accumulator or other utilization device (not shown). Alternatively, the turnbars may be oriented along a diagonal plane that inclines away from the downstream end of the primary conveyor. This variation raises the downstream edge of each document above the plane of the conveyors before the document is deposited on the cross conveyor 34. This variation operates whether the primary conveyor and cross conveyor lie in the same horizontal plane, or whether the cross conveyor lies in a slightly lower horizontal plane.

Figure 2:
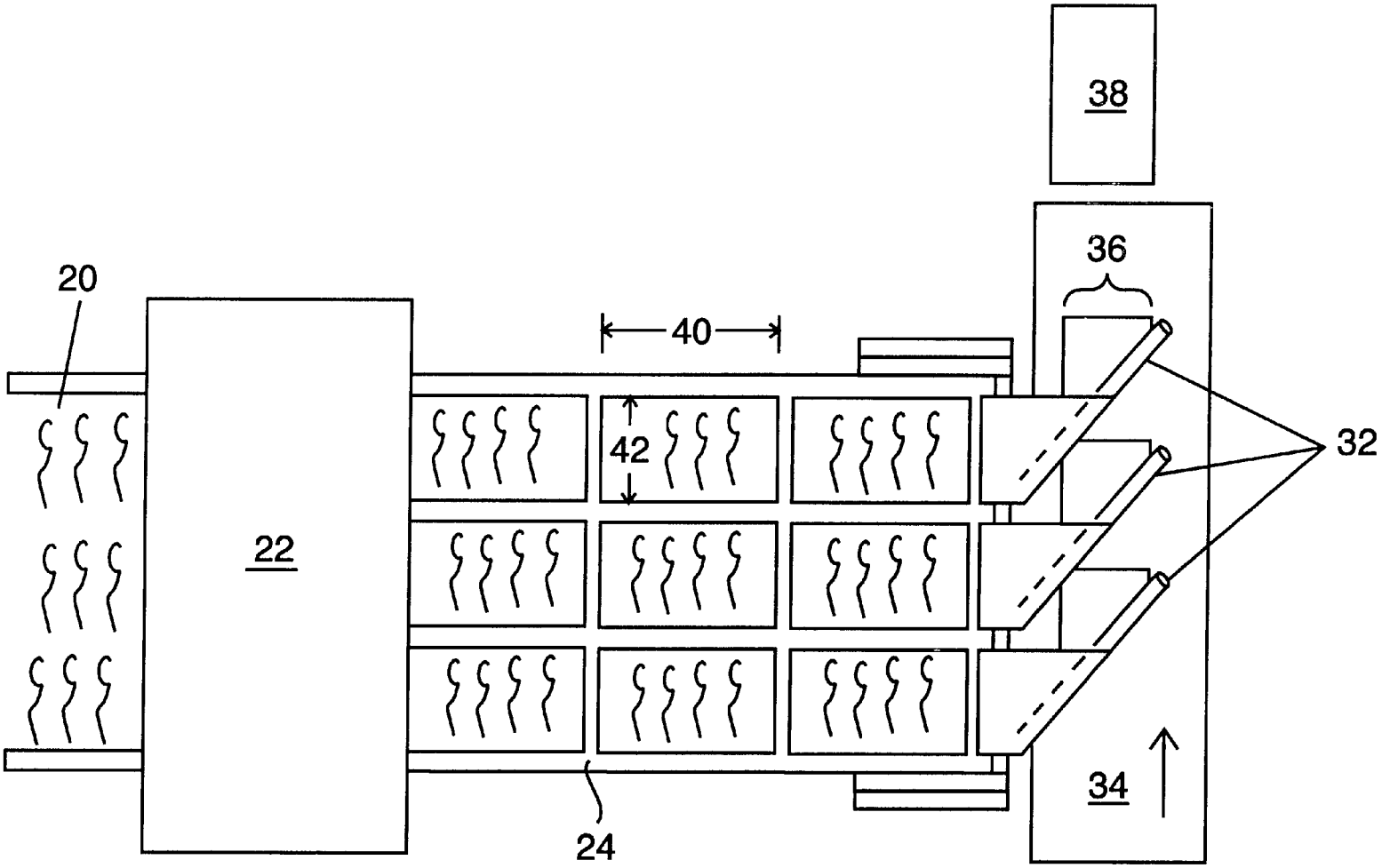
FIG. 2 is a top view of the invention depicted in FIG. 1.

Referring to FIG. 2, each document in a document stream has a length 40 and a width 42. When the cutter 22 cuts a web into documents such that the document length 40 is greater than the width 42, a portion of each document may overlap a portion of the merged document stream 36 on the cross conveyor 34 as it passes over its turnbar 32. While this characteristic will be most common due to the traditional size of the documents, it is unnecessary to create a merged document stream. The document width 42 may exceed its length 40, so that the merged document stream will consist of a series of non-overlapping documents. Such a merged stream of documents may be handled, stacked, or manipulated for some purpose, but the overlapping or shingled array has been found to be most desirable for downstream handling purposes.

Figure 3:
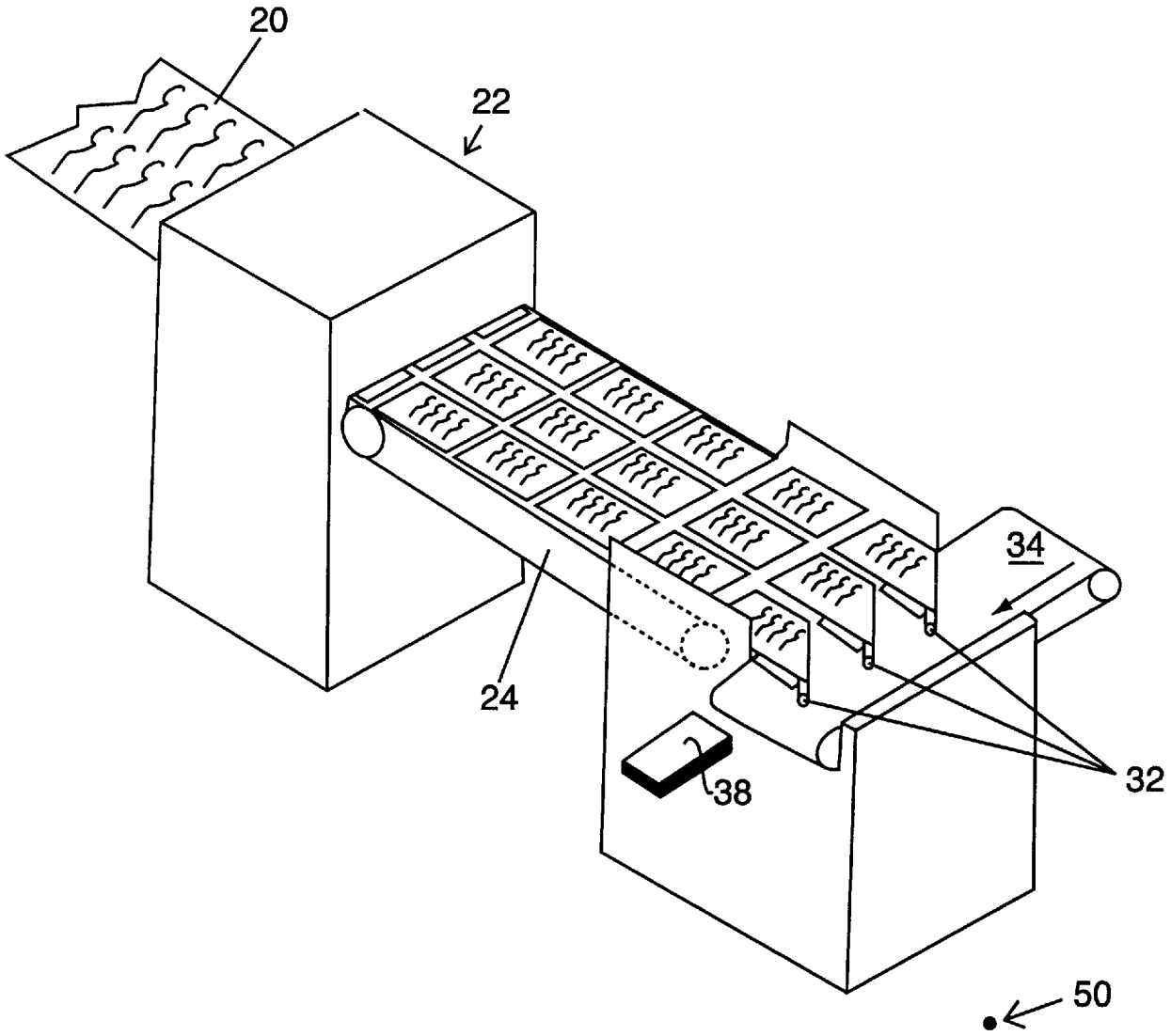
FIG. 3 is a perspective view similar to FIG. 1, but reoriented to merge the document streams in an order different from that of FIG. 1.

The turnbars 32 are preferably adjustable to provide adaptability to the invention. FIG. 1 and FIG. 3 illustrate how reorienting the turnbars and the direction of the cross conveyor 34 can redirect the merged document stream 36 to either side of the cross conveyor 34. For example, FIG. 1 shows a first document stream 26, a second document stream 28, and a third document stream 30 merged so that the resulting pages are ordered having a document from the third stream 30 on top of a document from the second stream 28, which is on top of a document from the first stream 26 (assuming the printed side of each page faces up while on the primary conveyor 24). Reversing the turnbars to the configuration of FIG. 3 inverts that order, so that a document from the first stream 26 lies on top of a document from the second stream 28, which is on top of a document from the third stream 30. Considering that this invention merges any number of side-by-side document streams, this variation provides a great deal of adaptability for a number of printing applications. Three, four, five or more side-by-side document streams may be merged in any order with little more than manually or mechanically repositioning the turnbars. The speed of the cross conveyor 34 is independent from the primary conveyor 24, and can be increased to accommodate increasing numbers of document streams being merged. However, the speed of the cross conveyor 34 must always be at least as fast as the speed of the primary conveyor 24, else the flow of documents will back up.

Figure 4:
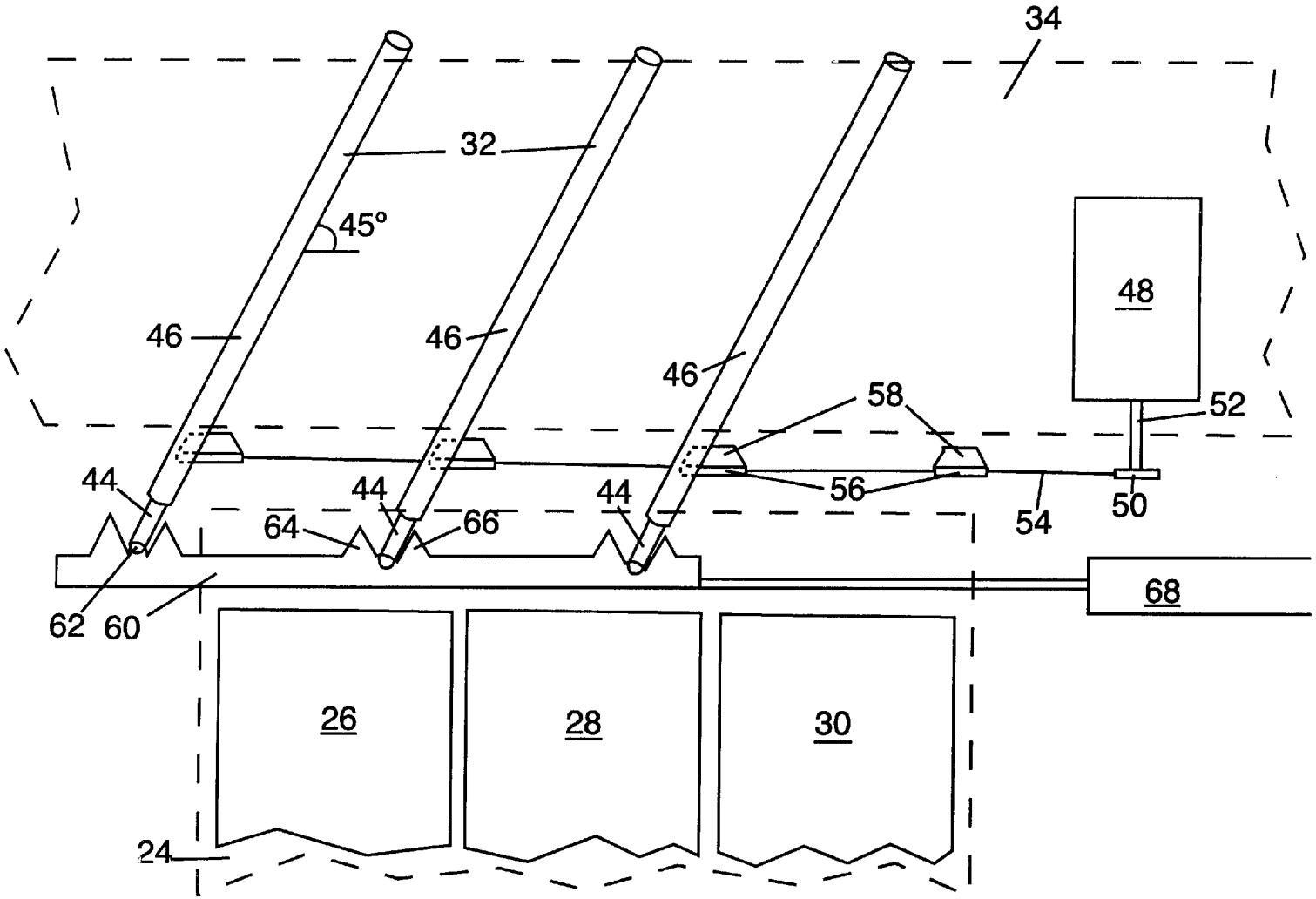
FIG. 4 is a cutaway top view revealing the turnbar connections and shifting mechanism.

An isolated view of the turnbars of the alternative embodiment is shown in FIG. 4. The primary conveyor 24 and the cross conveyor 34 are shown in shadow so as not to obscure relevant details, but are in fact in the foreground. The turnbars 32 include a core 44 and a rotatable sleeve 46 around the core 44. Each sleeve 46 is driven by a motor 48 having a driven pulley 50 at the end of a driveshaft 52. The driven pulley 50 engages a drive belt 54, which in turn drives similar remote pulleys 56 that are fixedly attached to conical wheels 58. The conical wheels 58 are made of a high friction material such as rubber, so that they drive the sleeves 46 when in contact, as shown. The conical wheels 58 are located slightly behind the sleeves 46 rather than directly alongside for a purpose to be described later.

Each of the turnbar cores 44 is hingedly connected to a mount 60. Alongside each hingepoint 62 are a left turnbar stop 64 and a right turnbar stop 66. When the cross conveyor 34 draws documents toward the right side of FIG. 4, the turnbars 32 are positioned as shown, wherein the turnbar core 44 rests against the right turnbar stop 66. When the cross conveyor draws documents toward the left side of FIG. 4, the turnbars are repositioned to slant in the direction opposite that shown, and the turnbar cores 44 rest against the left turnbar stops 64.

This repositioning of the turnbars 32 is done by a solenoid 68 having an actuating arm 70. As shown, the actuating arm 70 is extended, driving the mount 60 toward the left side of FIG. 4. Each turnbar sleeve 46 rests against the right turnbar stop 66 and comes in contact with a conical wheel 58 that drives the sleeve 46. Contact is positively maintained due to gravity acting on the long moment arm of the turnbar 32. The turnbars are repositioned from that shown by retracting the actuating arm 70 into the solenoid 68. Since the actuating arm is fixedly attached to the mount 60, the mount is drawn to the right side of FIG. 4. Resistance by the conical wheels 58 shifts the turnbars 32 along their hingepoint 62 to rest against the left turnbar stop 64. Continuing to draw the mount 60 toward the right side of FIG. 4 forces the turnbar sleeves 46 to rotate around the conical wheels 58 until the turnbar 32 passes to the opposite side of the conical wheel 58. The mount continues to the right and each turnbar encounters a different conical wheel 58. Since the turnbar core 44 rests against the left turnbar stop 64 as it moves further toward the right, the turnbar sleeve again rotates around this second conical wheel 58 until the turnbar 32 passes to the opposite side of its second conical wheel 58. This opposite side is the right side of the conical wheels 58 from the perspective of the viewer in FIG. 4. Rotation of the driveshaft 52 must be reversed in this alternative embodiment in order for the turnbars 32 to pull a document around it when oriented in the opposite direction.

Thus when the cross conveyor 34 in FIG. 4 draws documents toward the right, the turnbars 32 are positioned as shown therein and documents in the first, second and third document streams (26, 28, and 30 respectively) first contact their respective turnbar along their left corner. Reversing the direction of the cross conveyor 34, the turnbars are repositioned to slant opposite that shown in FIG. 4 and the documents first contact their respective turnbar at their right corner.

In either orientation, the leading corner is drawn around the turnbar by its rotation. Each turnbar 32 is driven at the same speed, so only a single motor 48 is required. The rotational speed of the sleeves 46 matches the linear speed of the cross conveyor 34 in this alternative embodiment. Since the speed of the cross conveyor 34 must always be at least as fast as the speed of the primary conveyor 24 as described above, the speed of the turnbar sleeves 46 does not necessarily match the speed of the primary conveyor 24. Thus a document will be 'pulled' from the primary conveyor 24 by a turnbar 32 when their speeds do not match.

Figure 5:
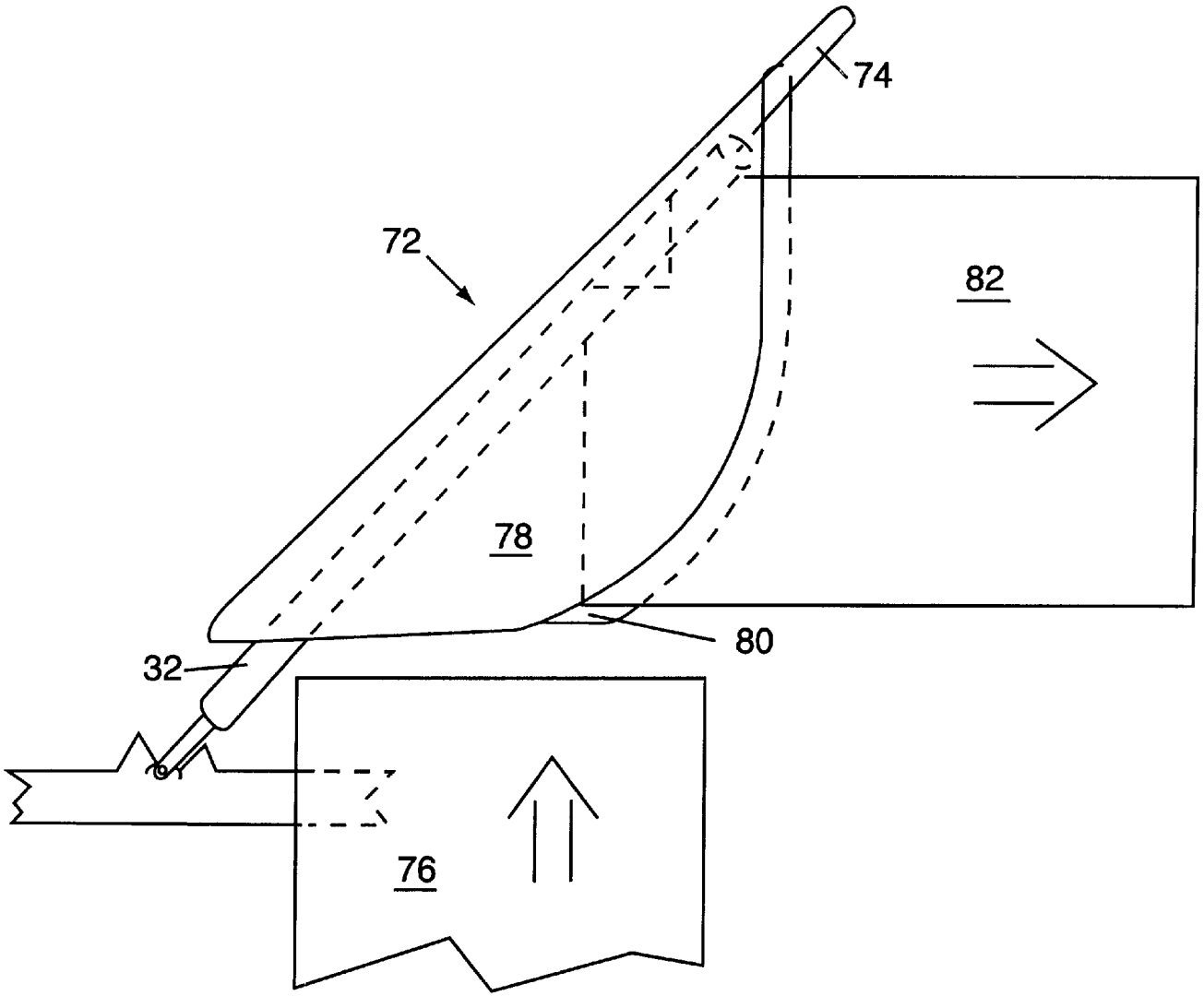
FIG. 5 is a cutaway top view of a single turnbar fitted with a plow.

FIG. 5 shows a plow 72 fitted onto a turnbar 32. The plow 72 positively channels a document 74 being fed from the primary conveyor 24 (not shown) into contact with its respective turnbar 32. The use of a plow 72 is especially valuable when the speed of the cross conveyor 34 and the tangential speed of the turnbars 32 exceed the speed of the primary conveyor 24. These plows 72 must be re-positioned when the direction of the cross conveyor 34 and the orientation of the turnbars 32 are changed, as discussed above. Using the conventions right and left as defined by an observer standing at the cutter 22 in FIG. 3 and looking toward the turnbars 32, when the cross conveyor 34 draws the merged document stream 36 to the right as in FIG. 3, the left corner of each document in the document streams 26, 28, and 30 is the first to contact the turnbar 32, and it does so on the turnbar's left side. Thus the orientation of FIG. 3 requires the plow 72 to be mounted as depicted in FIG. 5, to channel documents from the left side of the turnbar 32. When the cross conveyor 34 draws documents toward the left as in FIG. 1, the right corner of each document in the document streams 26, 28, and 30 is the first to contact the turnbar 32, and it does so on the turnbar's right side. Thus the orientation of FIG. 1 requires the plow 72 to be mounted opposite that shown in FIG. 5 to channel documents from the right side of the turnbar 32. The plows 72 may be manually or mechanically repositioned to correspond as described above to the position of the turnbars 32 and the direction of the cross conveyor 34. The plow 72 in FIG. 5 is manually mounted via a rod 74 inserted into an axial aperture in the turnbar 32. An incoming document 76 is fed by the primary conveyor 24 to pass underneath the top shield 78 of the plow 72. As the document is passed around the turnbar 32, it is redirected and passes over the top of the lower plate 80, which deposits the outgoing document 82 on the cross conveyor 34 (not shown). When the direction of the cross conveyor 34, and thus the slant of the turnbars 32, are reversed from that depicted in FIG. 5, the plow 72 is manually repositioned, such that the top shield 78 becomes the lower plate 80 and the lower plate 80 becomes the top shield 78. These positions may be fixed by a recess in the top of the turnbar 32 in which a lateral pin may rest, thus preventing rotation of the plow 72 except when the rod 74 is at least partially retracted from the axial aperture of the turnbar 32. Numerous other attachment means are available and reasonably known to those skilled in the art.

The above preferred and alternative embodiments and variations thereof are illustrative rather than exhaustive, and may be combined in whole or in part to attain a particular set of advantages. Such combinations and modifications thereof, are within the scope of this disclosure and will be apparent to those skilled in that art consistent with the teachings herein. The scope of the following claims encompass such modifications and variations as are applicable or appropriate under the Doctrine of Equivalents.

I claim:

1. An apparatus to merge multiple streams of, documents into a single merged document stream comprising:

a turnbar in line with each document stream and angled such that a document from a document stream passing over said turnbar is inverted and redirected;

a primary conveyor to carry each stream of documents in side-by-side relation toward said turnbars;

a cross conveyor underneath each said turnbar to carry the resulting merged document stream away from said turnbars; and drive means for said turnbar.

2. The apparatus of claim 1 further comprising a plow adjacent to each turnbar, said plow being so arranged as to channel documents from the primary conveyor around the turnbar onto said cross conveyor.

3. The apparatus of claim 1 wherein said drive means for each of said turnbars is a common drive means.

4. The apparatus of claim 3 wherein each of said turnbars includes a fixed core and a rotatable sleeve, and said common drive means includes conical wheels driven by a drive belt, said conical wheels contacting said rotatable sleeve.

5. The apparatus of claim 1 further including a turnbar mount upon which said turnbars are hingedly attached, said turnbar mount moveable so as to shift positions of said turnbars.

6. The apparatus of claim 5 wherein said turnbar mount includes mechanical stops against which said turnbars rest.

7. The apparatus of claim 1 wherein said drive means is capable of rotating said turnbars in either direction of rotation.

* * * * *

UNITED STATES PATENT AND TRADEMARK OFFICE

CERTIFICATE OF CORRECTION

PATENT NO. : 6,402,136 B1
DATED : June 11, 2002
INVENTOR(S) : Richard P. Lamothe It is certified that error appears in the above-identified patent and that said Letters Patent is hereby corrected as shown below:

Title page,
Item [57], ABSTRACT,
Line 4, replace the words “turnbar driven” with the words -- driven turnbar --.

Signed and Sealed this

Fifteenth Day of October, 2002

*Attest:*

*Attesting Officer*

JAMES E. ROGAN
*Director of the United States Patent and Trademark Office*